United States Patent [19]

Schmoock

[11] 4,169,518

[45] Oct. 2, 1979

[54] SAFETY BELT

[76] Inventor: Raymond Schmoock, 94 Beach Rd., Carmel, N.Y. 10512

[21] Appl. No.: 842,478

[22] Filed: Oct. 17, 1977

[51] Int. Cl.[2] ..... A62B 35/00; E06C 5/36; A62B 1/16

[52] U.S. Cl. ..... 182/8; 182/4

[58] Field of Search ..... 182/8, 9, 4, 3

[56] References Cited

U.S. PATENT DOCUMENTS

| | | | |
|---|---|---|---|
| 1,955,473 | 4/1934 | Raymer | 182/9 |
| 2,166,777 | 7/1939 | Walker | 182/4 |
| 2,857,086 | 10/1958 | Chamberlin | 182/4 |
| 2,886,227 | 5/1959 | Rose | 182/8 |

FOREIGN PATENT DOCUMENTS

| | | | |
|---|---|---|---|
| 613766 | 9/1926 | France | 182/9 |
| 716051 | 9/1950 | United Kingdom | 182/4 |

*Primary Examiner*—Reinaldo P. Machado
*Attorney, Agent, or Firm*—Robert J. Eichelburg

[57] ABSTRACT

A safety belt is disclosed comprising a first belt to be worn about the waist and a second belt slidably connected thereto. The second belt has ladder rung engaging members such as hooks on either end and may be adjustable. When the first belt is secured around the waist of a person and the ends of the second belt are secured to the rungs of a ladder, the person on the ladder may alternately reach to the left or right and slidably move the first belt towards either of the ends of the second belt without adjusting the length of the second belt and nonetheless remain securely held to the ladder.

3 Claims, 3 Drawing Figures

SAFETY BELT

SUMMARY OF THE INVENTION

The present invention relates to a safety belt adapted to be worn by a person for preventing the fall of such person on a ladder or when ascending or descending the ladder. The safety belt comprises a first belt member for fitting around the waist of a person. A second belt member is provided which is adapted to be secured to a ladder and terminates in a first free end and a second free end. The second belt is slidably secured to the first belt between the first free end and the second free end. Ladder rung engaging members extend from each of the free ends of the second belt whereby when the safety belt is worn and in use by a person on a ladder and secured to a ladder through the ladder engaging members, a person can alternately reach to the left or right of the ladder and slidably move the first belt towards either of the free ends without adjusting the length of the second belt and remain securely held to the ladder. The second belt may be adjustable in length. This may be conveniently accomplished by providing a second belt that extends longitudinally to a buckle having a first opening and a second opening separated by a cross-bar. The second belt passes through the first opening over the cross-bar and through the second opening and then in a looped configuration back to the cross-bar where it is secured. The looped configuration comprises one of the ends of the second belt. The ladder securing member may comprise a looped substantially rigid device lying in a first plane through which the second belt passes and is secured. The looped member extends into a hook lying in a second plane substantially normal to the first plane.

The second belt may be slidably secured to the first belt through a loop member adapted to slidably pass the second belt therethrough substantially from end to end.

Receiving members may be provided on the first belt for holding the ladder securing members thereto when the second belt is not in use.

The first belt may be adjustably securable to itself to change the circumference thereof when worn by a person.

DETAILED DESCRIPTION

Safety devices for securing a person to a ladder to prevent their fall are disclosed in the prior art in U.S. Pat. Nos. to Smith, 913,171; Rose et al, 2,886,227 and Acosta, 3,885,647. The afore-mentioned Smith Patent describes a fireman's belt that will allow the user to secure themselves to a ladder by means of a first belt to which is attached a second belt terminating in a hook used to engage a ladder rung. The second belt in this respect is secured to the first belt and is not slidably positionable on the first belt. This arrangement hinders the person using such a device from reaching alternately from left to right to any great degree and further comprises a single hook which is not as safe as a belt having two ladder rung engaging hooks.

The Smith reference discloses a third belt secured to the first one by means of a loop; however, the patentee discloses that this is employed to carry fire hose and thereby free the hands of the person using the device.

The Rose et al Patent discloses a safety belt comprising a first belt to be worn about the waist of a person and a second and a third belt secured to the first. The second and third belt terminate in hooks that are securable to step-ladder rungs. The prime disadvantage of using a device such as that of Rose et al is that a person secured to a ladder by such a device cannot lean alternately to the left or to the right of the ladder when the safety belt is fixed in place without adjusting the second and the third belts. In order to alternately move to the extreme left or right of a ladder when using the device of Rose et al, the second belt would have to be shortened and the third belt lengthened by the person while standing on the ladder which is not only inconvenient but attempting to make such adjustments while on the ladder could also present a safety problem.

Acosta illustrates a belt which comprises a single belt member that rides on specially provided tracks extending from the side rails of a step-ladder.

It is therefore an object of the present invention to overcome these and other difficulties encountered in the prior art. It is a further object of the present invention to provide a novel safety belt which will allow the user of the belt to alternately reach to the left or right of the ladder without adjusting the length of the belt during use and further allow the person using such a belt to remain securely held to the ladder.

These and other objects have been achieved according to the present invention and will become apparent by reference to the disclosure and claims that follow as well as the appended drawing.

Figure 1:
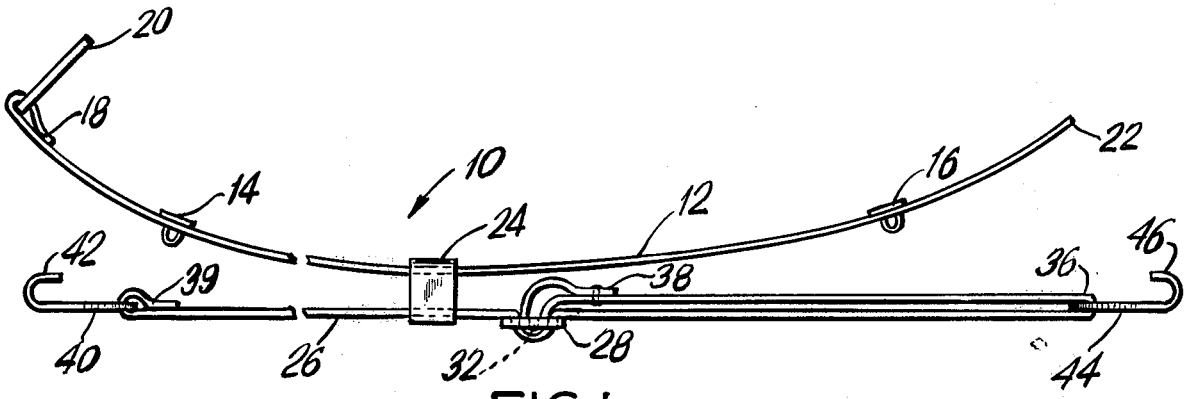
FIG. 1 comprises a plan view of a safety belt comprising a first and second belt slidably connected one to the other in which the second belt terminates in hooks securable to the rungs of a ladder.
Figure 2:
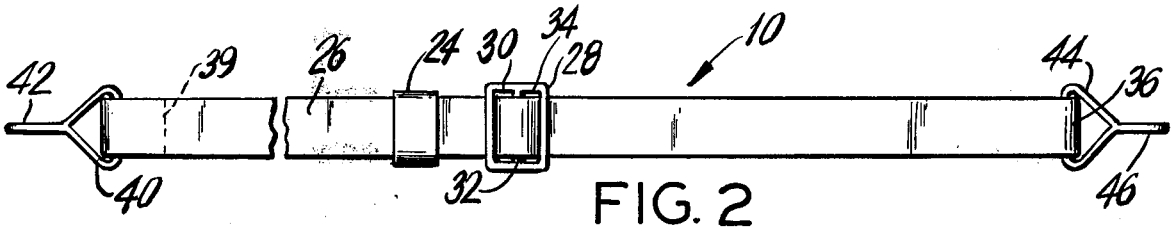
FIG. 2 comprises a plan view of the safety belt described with respect to FIG. 1 and FIG. 3 illustrate the use of the safety belt of the present invention by a person standing on a ladder.
Figure 3:
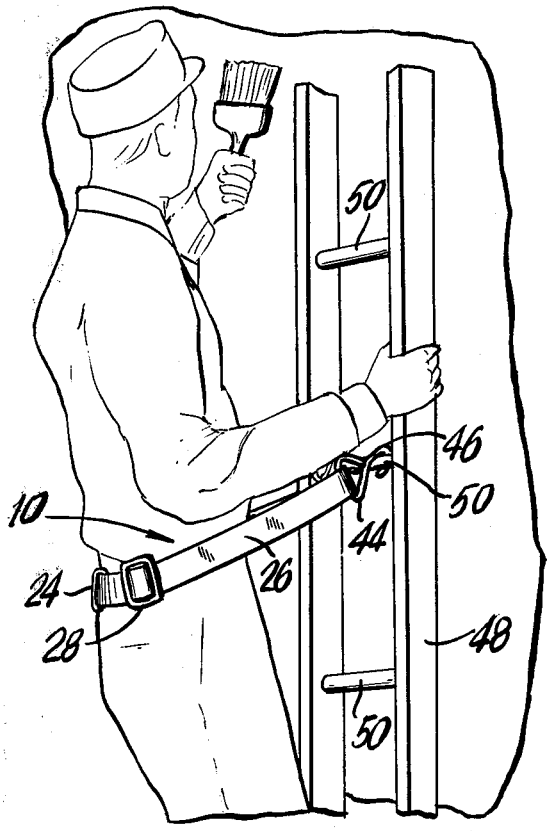

Referring to the drawing and FIGS. 1-3, a safety belt 10 is illustrated comprising a belt 12 adapted to be positioned around the waist of a person, belt 12 terminating in a loop 18 which secures a buckle 20 thereto at one end. The opposite end 22 of belt 12 is inserted through the buckle 20 and may be drawn through the buckle to change the circumference of belt 12 when worn.

A loop 24 extends from belt 12 and may be either arranged to move along the length of belt 12 or may be secured to belt 12 and is adapted to slidably receive a second belt 26. Belt 26 extends through opening 30 and over cross-bar 32 and then through opening 34 of buckle 28 for a distance and then to a loop 36 and back along its length so that the end 38 in turn is passed through opening 34 and then over cross-bar 32 and through opening 30. End 38 is riveted to belt 26 or otherwise secured thereto to allow the length of belt 26 to be adjusted through buckle 28. Loop 36 comprises one end of belt 26 and has a triangular shaped open hook ring 44 lying in a plane, ring 44 extending into a hook 46 lying in a plane substantially normal to the plane of ring 44. Ring 44 and hook 46 comprise a ladder securing member although any of the art known equivalents thereof may be employed in lieu of the embodiment illustrated. Similarly, the end opposite end 36 of belt 26 terminates in a loop 39 for securing an open triangular shaped ring 40 thereto, ring 40 lying in a plane and extending into a hook 42, the latter lying in a plane normal to the plane of ring 40. The ring 40 and hook 42 also comprise a ladder securing member and any of the art known equivalents thereof may be employed in lieu thereof as with ring 44 and hook 46. Loop 39 is secured to the length of belt 26 by a rivet or other art known equivalent securing means.

Eyelets 14 and 16 are provided along the length of belt 12 to receive respectively the hooks 42 and 46.

In use, and referring to FIG. 3, the belt 12 is secured around the waist of a person and the hooks 42 and 46 on belt 26 are secured to the rungs 50 of a ladder 48. As the person using the ladder 48 ascends or descends the ladder, the hooks may be removed and placed on either an upper or a lower rung as the case may be.

As can be seen by reference to FIG. 3 when employing the belt of the present invention, the person using it may lean alternately to the left or to the right of the ladder such as is required when painting a surface such as the side of a house where in order to save the time of moving the ladder to a new area to be painted, the painter may lean to either the left or the right side of the ladder to extend the area that may be painted to one beyond the immediate reach from the ladder. This is easily accomplished with the safety belt of the present invention by virtue of the slidable arrangement of belt 26 with respect to belt 12 through the loop 24. In the prior art devices such as the Rose et al and Smith Patents as well as the Acosta reference this was not possible since the belt employed in those references did not allow the freedom of movement to a person using the belt to permit them to extend to the left or right of a ladder without first adjusting the belt. With the present invention, the belt 26 does not have to be lengthened in order to increase the reach to the left or right, the step of reaching left or right being accomplished merely by moving in either direction as the need arises.

One of the other advantages of the present invention is that when used by a person as described herein, leaning to the left or right from a position on the ladder will not cause the weight of the user or the strain on the ladder engaging means or hooks 42 and 46 to be transferred to only one of such ladder engaging means as is the case when using the Rose et al device. When using the present invention, the ladder engaging means will take up the strain or weight of a person in a substantially equal manner and as such less strain is placed on each individually which is a safety feature not afforded by the prior art devices.

Although the invention has been described by reference to some embodiments, it is not intended that the novel safety belt be limited thereby but that modifications thereof are intended to be included within the broad spirit and scope of the foregoing disclosure, the appended drawing and the claims.

What is claimed is:

1. A safety belt adapted to be worn for preventing the fall of a person from a ladder or when ascending and descending a ladder comprising first belt means for fitting around the waist of a person, said first belt being adjustably securable to itself to increase and decrease the circumference thereof, second belt means adapted to be secured to a ladder and terminating in a first free end and a second free end, said second belt being adjustable in length, said second belt means slidably secured to said first belt means through loop means extending around said first belt means and said second belt means said loop means adapted to slidably pass said first belt therethrough completely from end to end and to pass said second belt substantially therethrough, ladder rung engaging means extending from each of said free ends, receiving means on said first belt for holding said ladder rung engaging means thereto whereby when said safety belt is worn and used by a person on a ladder and secured to said ladder through said rung engaging means, said person can alternately reach to the left or right of said ladder and slidably move said first belt towards either of said free ends without adjusting the length of said second belt and remain securely held to said ladder.

2. The safety belt of claim 1 where said second belt extends longitudinally to a buckle having a first opening and a second opening separated by a cross-bar and through said first opening over said cross-bar and through said second opening and then in a looped configuration back to said cross-bar where it is secured, said looped configuration comprising one of said free ends.

3. The safety belt of claim 2 where said ladder securing means comprises a looped substantially rigid member lying in a first plane through which said second belt passes and is secured, said looped member extending into a hook lying in a second plane substantially normal to said first plane.

* * * * *